US009873019B2

(12) United States Patent
Hwang et al.

(10) Patent No.: US 9,873,019 B2
(45) **Date of Patent: *Jan. 23, 2018**

(54) GOLF BALL HAVING SURFACE DIVIDED BY TRIANGULAR CONCAVE SECTORS

(71) Applicant: VOLVIK INC., Chungcheongbuk-do (KR)

(72) Inventors: In Hong Hwang, Gyeonggi-do (KR); Kyung Ahn Moon, Seoul (KR)

(73) Assignee: VOLVIK INC., Chungcheongbuk-do (KR)

( * ) Notice: Subject to any disclaimer, the term of this patent is extended or adjusted under 35 U.S.C. 154(b) by 0 days.

This patent is subject to a terminal disclaimer.

(21) Appl. No.: 15/139,125

(22) Filed: Apr. 26, 2016

(65) Prior Publication Data

US 2016/0317872 A1 Nov. 3, 2016

Related U.S. Application Data

(63) Continuation-in-part of application No. 14/821,058, filed on Aug. 7, 2015, now Pat. No. 9,440,116.

(30) Foreign Application Priority Data

Apr. 30, 2015 (KR) ..... 10-2015-0061761

(51) Int. Cl.
*A63B 37/06* (2006.01)
*A63B 37/00* (2006.01)

(52) U.S. Cl.
CPC ..... *A63B 37/0006* (2013.01); *A63B 37/0004* (2013.01); *A63B 37/0009* (2013.01)

(58) Field of Classification Search
CPC ..... A63B 37/0007; A63B 37/0011
(Continued)

(56) References Cited

U.S. PATENT DOCUMENTS 4,560,168 A 12/1985 Aoyama
5,106,096 A 4/1992 Dunn
(Continued)

FOREIGN PATENT DOCUMENTS

JP H08-010355 A 1/1996
JP H08-084787 A 4/1996
(Continued)

OTHER PUBLICATIONS

Murray, D. *Spherical Trigonometry*. N. Y., Longmans, Green, and Co., 1908. KE6381.
(Continued)

*Primary Examiner* — Raeann Gorden
(74) *Attorney, Agent, or Firm* — Kilpatrick Townsend & Stockton LLP

(57) ABSTRACT

In a golf ball having a surface divided by triangular concave sectors, an area of a surface of a sphere is divided into a plurality of areas forming spherical polyhedron and a plurality of dimples are formed for each of the plurality of areas. A triangular concave sector is formed by continuously forming a plurality of triangular concave on each arc along great circles dividing the surface of the sphere into the plurality of areas. A planar shape of each of the plurality of triangular concave is a triangle and the bases of the triangular concaves are arranged on the arc along the great circles. Peaks of adjacent triangular concaves are located at opposite sides with respect to the arc along the great circles.

6 Claims, 9 Drawing Sheets

(58) Field of Classification Search
USPC ..... 473/383–384
See application file for complete search history.

(56) References Cited

U.S. PATENT DOCUMENTS

| | | | | |
|---|---|---|---|---|
| 5,338,039 | A | 8/1994 | Oka et al. | |
| 5,494,631 | A | 2/1996 | Oka et al. | |
| 5,547,197 | A | 8/1996 | Pocklington | |
| 5,586,951 | A | 12/1996 | Sugiura | |
| 5,879,245 | A | 3/1999 | Hwang | |
| 5,957,787 | A | 9/1999 | Hwang | |
| 6,450,902 | B1 | 9/2002 | Hwang | |
| 6,709,349 | B2 | 3/2004 | Sullivan | |
| 7,618,333 | B2 | 11/2009 | Nardacci et al. | |
| 9,440,116 | B1 * | 9/2016 | Hwang | A63B 37/0006 |
| 2002/0077198 | A1 | 6/2002 | Sajima | |
| 2003/0224878 | A1 | 12/2003 | Sullivan | |
| 2012/0302377 | A1 | 11/2012 | Sato et al. | |
| 2013/0288827 | A1 | 10/2013 | Hwang et al. | |
| 2014/0004977 | A1 | 1/2014 | Hwang et al. | |
| 2015/0057106 | A1 | 2/2015 | Kishishita | |

FOREIGN PATENT DOCUMENTS

| | | | |
|---|---|---|---|
| JP | H08-276035 | A | 10/1996 |
| JP | 2002-126127 | A | 5/2002 |
| JP | 2006-130318 | A | 5/2006 |
| KR | 1992-0021177 | A | 12/1992 |
| KR | 1996-0004335 | B1 | 4/1996 |
| KR | 10-0360310 | B1 | 11/2002 |
| KR | 10-1197666 | B1 | 10/2012 |
| KR | 10-1238734 | B1 | 3/2013 |
| KR | 10-2013-0120571 | A | 11/2013 |
| KR | 10-2014-0116863 | A | 10/2014 |

OTHER PUBLICATIONS

Dhillon, V. *Spherical Trigonometry*. UK, Sheffield University, Sep. 30, 2009 [retrieved on Feb. 29, 2016]. Retrieved from the Internet: <URL: http://www.vikdhillon.staff.shef.ac.uk/teaching/phy105/celsphere/phy105_geometry. html>, 7 pages.

* cited by examiner

36° = Straight Line 3°+ triangular concave sector 30°+ Straight Line 3°

GOLF BALL HAVING SURFACE DIVIDED BY TRIANGULAR CONCAVE SECTORS

CROSS-REFERENCE TO RELATED APPLICATION

This is application is a continuation-in-part of U.S. patent application Ser. No. 14/821,058, filed Aug. 7, 2015, which claims the benefit of priority of Korean Patent Application No. 10-2015-0061761, filed Apr. 30, 2015, the disclosures of which are herein incorporated by reference in their entirety for all purposes.

BACKGROUND

1. Field

One or more exemplary embodiments relate to a golf ball having a surface divided to arrange dimples, in which a surface of a sphere is divided not by great circles GCs but by triangular concave sectors and the dimples are arranged in the divided surfaces so that a spherical surface, that is, an overall concave surface, is increased to more easily facilitate lift, thereby increasing a flight distance.

2. Description of the Related Art

Concave surfaces including dimples in a surface of a golf ball are directly involved in flight in terms of aerodynamics and greatly affect flight performance of the golf ball.

A golf ball being hit by a golf club generates backspin according to a loft angle of the golf club and simultaneously flies forward due to strong repulsive elasticity generated from a core of the golf ball. The golf ball has a flight trajectory that differs according to various formation specifications of the golf ball.

Even when initial trajectories are similar to each other, the shape of a trajectory, a peak of a trajectory, a flight duration, etc. may considerably vary according to the type and shape of dimples and an arrangement of the dimples. Also, even when an identical player hits a golf ball using the same golf club, flight characteristics appear to be different according to a repulsive elasticity capability and rigidness of a golf ball and a difference in spin performance of the golf ball. Particularly, flight duration, height of a peak, straight flight feature, wind effect, etc. may vary greatly according to the shape, size, number, area ratio, depth, arrangement method of dimples, etc.

Among them, an area ratio occupied by dimples is an important factor for the flight characteristics as well as the size of a dimple. As the area ratio increases, lift may be easily increased.

In general, circular dimples are widely used for dimple arrangement. For a relatively small circular dimple, lift may be difficult to achieve, but wind effect may be less, thereby enabling stable flight. In contrast, for a relatively large circular dimple, lift may be easily achieved but wind effect is greater and thus flight stability is deteriorated. Accordingly, the golf ball flies in an unintended direction, rather than toward a desired destination. Also, in the case of a large dimple, when putting, there may be a difference between when a surface of a putter contacts a land surface where no dimple is formed and when the surface of a putter directly contacts a surface of a dimple and thus a directional consistency may not be guaranteed. In general, a golf ball having a relatively large sized dimples, so that the number of dimples over an entire surface of the golf ball are about 252~312 circular dimples, may have a trajectory that is too high. Accordingly, the golf ball may be greatly affected by the wind and thus a flight distance may become irregular and directivity may be deteriorated. In particular, the error may become severe when short distance putting. A golf ball having many small dimples and less large dimples, that is, about 372~432 dimples, may have a relatively low trajectory and may be less affected by the wind compared to the above-described golf ball having many relatively large dimples. However, it may be seen that a flight distance of a golf ball hit by a golf club with a fast head speed relatively increases. Accordingly, when the head speed is slow, particularly in the case of a golf ball having a soft touch, it may be difficult to obtain a desired flight distance.

Accordingly, many manufacturers have developed golf balls which may increase a flight distance by increasing an area ratio of dimples to help achieve lift which increases a flight duration. The following are examples of golf balls invented as a result of the above.

U.S. Pat. No. 5,494,631 discloses that a dimple area ratio is increased to its maximum by arranging dimples on the equator of a golf ball. Although a dimple area ratio may be increased, since a precise process to remove resin burr left in the dimples located on the equator is needed, considerable time is needed for a grinding process.

U.S. Pat. No. 6,709,349 discloses that a dimple area ratio is increased by arranging dimples on the equator of a golf ball and setting several dimples in a group, and a mold parting line is formed above a dimple group and then under a next dimple group so that the mold parting line is alternately formed on an upper mold and a lower mold. When a dimple is larger than a certain size, the dimple may be damaged during post-processing.

U.S. Pat. No. 7,618,333 discloses that dimples located over a mold parting line form a so-called seamless mold parting line. The mold parting line having a zigzag amplitude of 0.02 inches or less causes dimples to tightly contact each other above and under the mold parting line without spaces therebetween. Accordingly, a dimple area ratio is higher than a general mold parting line formed of a straight line and the dimples may be regularly arranged. In this case, however, buffing to prevent damage to the dimples may be difficult.

SUMMARY

One or more exemplary embodiments include a golf ball which may greatly increase a dimple area ratio, facilitate buffing process to prevent damage to dimples and maintain uniform symmetry, increase a flight duration of a golf ball, and remove excessive wind effect over an entire surface of a golf ball to make pressure drag constant, thereby enabling flight stability and increasing a flight distance.

Additional aspects will be set forth in part in the description which follows and, in part, will be apparent from the description, or may be learned by practice of the presented exemplary embodiments.

According to one or more exemplary embodiments, in a golf ball having a surface divided by triangular concave sectors, an area of a surface of a sphere is divided into a plurality of areas forming a spherical polyhedron and a plurality of dimples are formed on the surface of the areas. A triangular concave sector is formed by continuously forming a plurality of triangular concave on each arc along the great circles dividing the surface of the sphere into the plurality of areas. A planar shape of each of the plurality of triangular concave is a triangle and bases of the triangular concaves are arranged on the arc along the great circles. Peaks of adjacent triangular concaves are located at opposite sides with respect to the arc along the great circles.

The spherical polyhedron may have 6-8 faces, an angular distance of one triangular concave sector may be about 60°, and the number of triangular concave may be nine and thus an angular distance of the base, arranged on the great circles, of one triangular concave is about 60°/9 (6.666667° when calculated to the $6^{th}$ decimal place).

A height of the triangular concave may be within a range of angular distances of about 2° to about 3°.

The spherical polyhedron may have 6-8 faces, an angular distance of one triangular concave sector may be about 60°, and the number of triangular concave may be eleven and thus an angular distance of the base, arranged on the great circles, of one triangular concave is about 60°/11 (5.45454545° when calculated to the $8^{th}$ decimal place).

A height of the triangular concave may be within a range of angular distances of about 1.9° to about 2.5°.

The dimples may be circular dimples.

The dimples may be spherical polygonal dimples.

A mold parting line corresponding to one of great circles on the surface of the golf ball is linear.

According to one or more exemplary embodiments, in a golf ball having a surface divided by triangular concave sectors, an area of a surface of a sphere is divided into a plurality of areas forming spherical polyhedron and a plurality of dimples are formed for each of the plurality of areas. A triangular concave sector is formed by continuously forming a plurality of triangular concave on an arc along the great circles dividing the surface of the sphere into the plurality of areas and by arranging a straight line section, along which no triangular concave is formed, at opposite ends of the triangular concave sector. A planar shape of each of the plurality of triangular concave is a triangle and bases of the triangular concaves are arranged on the arc along the great circles. Peaks of adjacent triangular concaves are located at opposite sides with respect to the arc along the great circles.

The spherical polyhedron may have 20-12 faces, an angular distance of one triangular concave sector may be about 36°, and the number of triangular concave may be five and an angular distance of the base, arranged on the great circles, of one triangular concave is about 6°.

An angular distance of a straight line section included in opposite ends of the triangular concave sector may be about 3° respectively.

A height of the triangular concave may be within a range of angular distances of about 2° to about 3°.

The dimples may be circular dimples.

The dimples may be spherical polygonal dimples.

A mold parting line corresponding to one of great circles on the surface of the golf ball is linear.

BRIEF DESCRIPTION OF THE DRAWINGS

These and/or other aspects will become apparent and more readily appreciated from the following description of the exemplary embodiments, taken in conjunction with the accompanying drawings in which.

DETAILED DESCRIPTION

Figure 1:
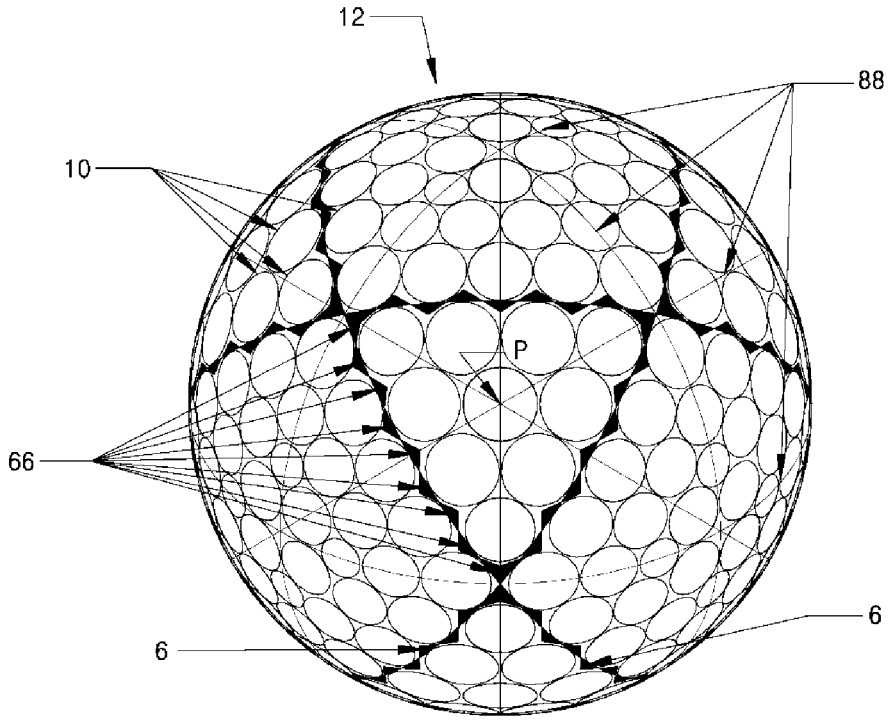
FIG. 1 illustrates a structure of a golf ball according to an exemplary embodiment.

Reference will now be made in detail to exemplary embodiments, examples of which are illustrated in the accompanying drawings, wherein like reference numerals refer to like elements throughout. In this regard, the present exemplary embodiments may have different forms and should not be construed as being limited to the descriptions set forth herein. Accordingly, the exemplary embodiments are merely described below, by referring to the figures, to explain aspects of the present description.

In general, dimples are formed in a surface of a golf ball because the role of dimples is important in terms of aerodynamics. As a golf ball flies to a target position with a backspin, the dimples make the air flow slowly under the golf ball which increasing pressure and the air flow fast above the golf ball which decreasing pressure, thereby generating the lift by Bernoulli's principle that enables longer flight. In this state, pressure drag and friction drag increase as well. It is well known that circular dimples have been most widely used as the dimples of a golf ball. When arranging circular dimples in a surface of a sphere, a golf ball is formed in the shape of a spherical polyhedron including a plurality of spherical polygons obtained by dividing the surface of a sphere by great circles and the circular dimples are arranged having a left-right symmetry on the spherical polyhedron. In addition to the circular dimple, dimples of various shapes such as an ellipse, a spherical hexagon, a spherical triangle, etc. have been used.

Although there is a need to increase a dimple area ratio, convenience in a manufacturing process cannot be ignored so that dimples need to be symmetrically arranged. A symmetric arrangement of dimples may be possible when the dimple arrangement around a mold parting line near an equator line and a dimple arrangement around other great circles are matched with each other. For example, in a spherical polyhedron of 20-12 faces, only when a dimple arrangement around the equator line that is one of the great circles and dimple arrangements at other five positions are matched with each other, may it be said that symmetry is achieved.

Accordingly, if dimple arrangements around other great circles are tightly arranged in a zigzag form, the dimple arrangement around the equator line necessarily has the same arrangement form. The equator line is widely used for the mold parting line, when dimples are tightly arranged in a zigzag form, much effort should be made to prevent damage to the dimples in post-processing after molding, which substantially deteriorates productivity in a manufacturing process of a golf ball.

As described above, dimple arrangements at opposite sides of a boundary shared by spherical polygons of a spherical polyhedron, which are generated when the surface of a sphere is divided by great circles, are arranged to alternately and closely contact each other in order to increase an overall dimple area ratio. For example, when four dimples are arranged at one side, three or five dimples are arranged at the opposite side of a segment of the great circle as if being inserted between the dimples. Accordingly, an empty land part may be reduced. However, since a mold forming a cover of a golf ball is necessarily divided into upper and lower molds, a mold parting line is generated after molding.

Since the mold parting line is one of the great circles, in order to make an accurate symmetry with another dimple arrangement, the dimples are arranged to alternatively closely contact one another. Accordingly, the dimple arrangement around the mold parting line naturally becomes a so-called seamless dimple arrangement. This mold parting line makes a difficulty to performing a buffing process, which is for removing unnecessary materials after molding. In particular, it is difficult to make the gates needed for molding. Thus, in the present invention, dimples are arranged by dividing a sphere by sectors formed of triangular concaves having a same size in a zigzag form as a segment of an existing great circle, instead of arranging dimples by dividing a sphere by the great circles. Since a mold parting line of a golf ball as above is a straight line, no difficulty occurs in processing after molding and the dimples around the equator line may not be damaged. Accordingly, an accurate symmetry may be obtained over an overall sphere and flight has stability. Also, a dimple area ratio occupied by the concaves is high so that more lift may be obtained than a general dimple arrangement.

Figure 2:
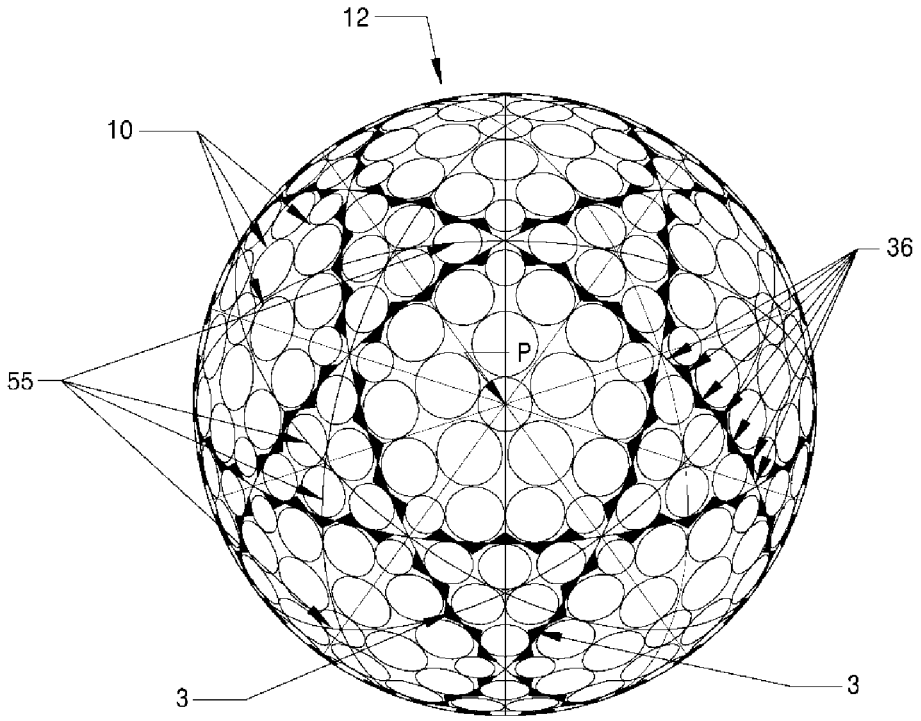
FIG. 2 illustrates a spherical surface divided by triangular concave sectors to make a dimple arrangement illustrated in FIG. 1.
Figure 3:
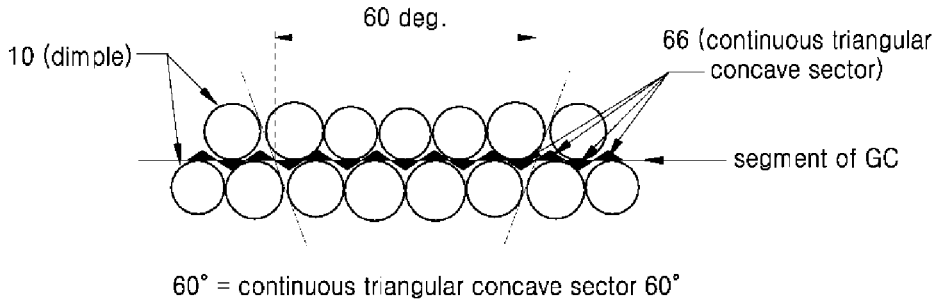
FIG. 3 illustrates a positional relationship between dimples and one of the triangular concave sectors dividing a surface of the golf ball illustrated in FIG. 1.
Figure 4:
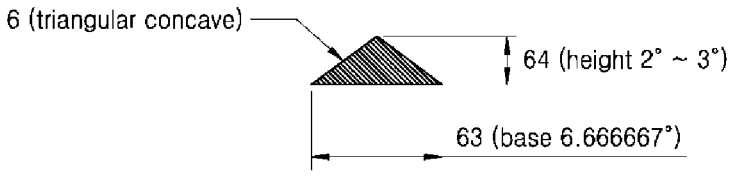
FIG. 4 illustrates a size of one triangular concave illustrated in FIG. 3.

FIG. 1 illustrates a structure of a golf ball 12 according to an exemplary embodiment. FIG. 2 illustrates a spherical surface divided by triangular concave sectors to make a dimple arrangement illustrated in FIG. 1. FIG. 3 illustrates a positional relationship between dimples and one of the triangular concave sectors dividing a surface of the golf ball illustrated in FIG. 1. FIG. 4 illustrates a size of one triangular concave illustrated in FIG. 3.

As illustrated in FIG. 1, in the golf ball according to the present exemplary embodiment, a surface of a sphere is divided into a spherical polyhedron of 6-8 faces, that is, a spherical polyhedron corresponding to a three-dimensional (3D) figure obtained by truncating 8 triangular pyramid corner portions from a regular hexahedron, and dimples are arranged in the divided surfaces. Also, the plurality of triangular concaves are arranged on each arc of the spherical polyhedron of 6-8 faces dividing a sphere. A triangular concave has a triangular planar shape and is formed by being indented to a predetermined depth from the surface of the golf ball. Since the triangular concave is formed on the spherical surface of the golf ball, the outline of the triangular concave is spherical triangle. The triangular concave is distinguished from the dimples arranged in a divided area in that the triangular concave is arranged on each great circle arc dividing each area of the spherical polyhedron. A planar area of the triangular concave is smaller than a planar area of a dimple and has a depth that is similar to or shallower than the dimple when formed at its maximum.

A series of triangular concaves arranged on one arc of the spherical polyhedron are referred to as a triangular concave sector. In other words, each divided area of a spherical polyhedron is surrounded by the triangular concave sectors. The triangular concaves are continuously arranged in one triangular concave sector. The base of a triangular shape of each triangular concave is located on the great circle arc which dividing the spherical polyhedron. A peak facing the base is alternately arranged with respect to the arc dividing the spherical polyhedron. In other words, the arrangement of triangular concaves is in a zigzag form as a whole.

In the division structure of the spherical polyhedron of 6-8 faces, the length of an arc corresponding to one side of a polygon may be presented as an angular distance of about 60°. In other words, each surface area of the spherical polyhedron of 6-8 faces may be formed in a regular triangular shape and a square shape only. In this state, the lengths of the respective sides, that is, the respective arcs with respect to a sphere, are all identical to one another. Six arcs exist along a circumference of the great circles GCs 88 of the golf ball and the length of the six arcs with subtend to 360°, one triangular concave sector is located along one arc, the length of a triangular concave sector is same to the length of the corresponding arc, and the length of a triangular concave sector may be referred to as an angular distance of 60°. Mathematically, the length of an arc is calculated through a multiplication of a radius and a central angle. Since radii are all identical constants with respect to one sphere, accordingly, a ratio of the size of a central angle is calculated according to a ratio of the length of an arc. The angle length displays the length of the arc length of a sector. The sector is created with a line segment of a great circle GC and two lines that connecting the ends of the line segment of GC from the center of a sphere. That is, if the radius of the sphere is 1, the angular distance is equal to the arc length.

Accordingly, in the present exemplary embodiment, the length of one triangular concave sector 66 in the spherical polyhedron of 6-8 faces is presented as an angular distance of 60° and the length of the base of each triangular concave is presented by dividing 60° by the number of triangular concave included in the triangular concave sector 66.

As illustrated in FIG. 3, when one continuous zigzag triangular concave sector 66 that corresponds to one arc dividing the spherical polyhedron of 6-8 faces is arranged, dimples may be arranged at opposite sides of a triangular concave sector to correspond to the shapes of triangular concaves. In other words, as illustrated in FIG. 3, four dimples are arranged along a side of a triangular area and five dimples are arranged along a side of a rectangular area. Accordingly, the dimples may be easily arranged corresponding to the number of triangular concaves.

As illustrated in FIG. 4, the size of a triangular concave 6 according to the present exemplary embodiment is that a base 63 is about 6.666667° and a height 64 is about 2° to 3°. The length of the base is a value obtained by dividing 60° by 9 when one triangular concave sector having an angular distance of 60° includes nine triangular concave, as illustrated in FIG. 3. This size accurately corresponds to a size in which four dimples are arranged along one side of a spherical triangle of the spherical polyhedron of 6-8 faces and five dimples are arranged along one side of a spherical rectangle of the spherical polyhedron of 6-8 faces.

Also, dividing upper and lower sides of the triangular concave sector by an arc forming the great circle reduces difficulty in the post-processing in the manufacture of a golf ball by accurately making mold parting lines of upper and lower sides of a mold with respect to a segment of the great circle straight.

Figure 5:
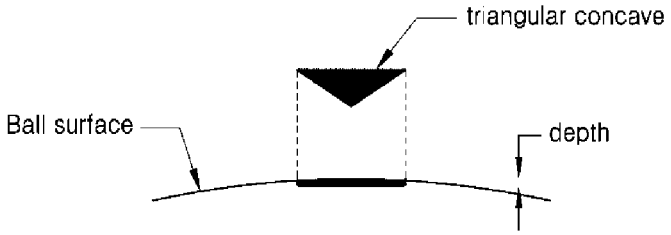
FIG. 5 illustrates a depth of one triangular concave from among a plurality of triangular concaves forming a triangular concave sector.

FIG. 5 illustrates a depth of one triangular concave from among a plurality of triangular concaves forming a triangular concave sector;

As illustrated in FIG. 5, the depths of triangular concave may be formed without a big difference or uniformly along a surface of a sphere of a golf ball. Also, when the depth of a triangular concave is formed at its maximum, the depth of the triangular concave surface may be formed to be similar to or lower than the depth of the dimple.

Figure 6:
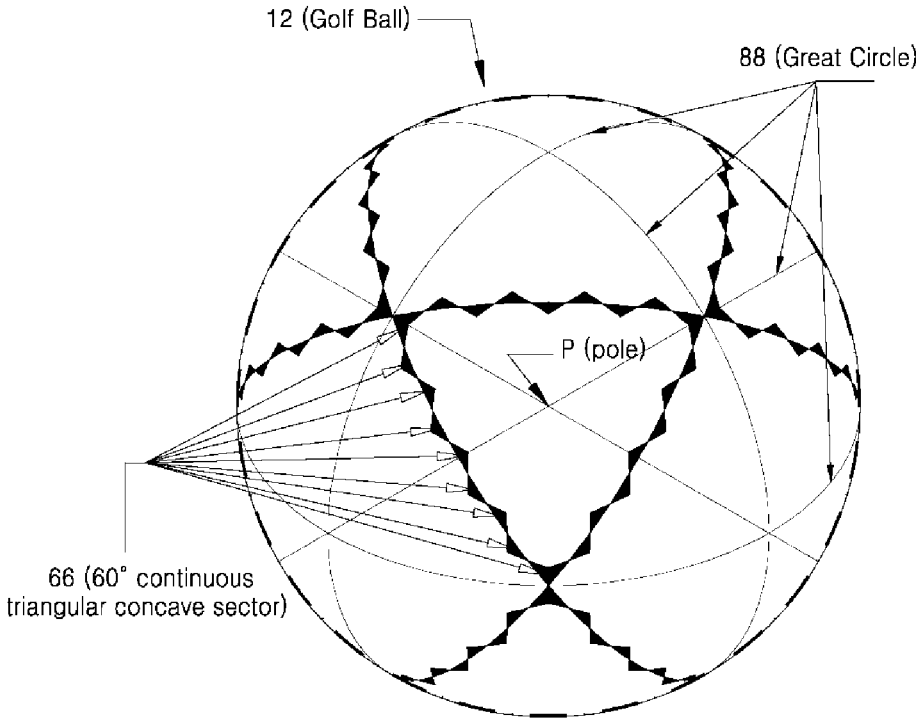
FIG. 6 illustrates a modified example of the exemplary embodiment of FIG. 1.
Figure 7:
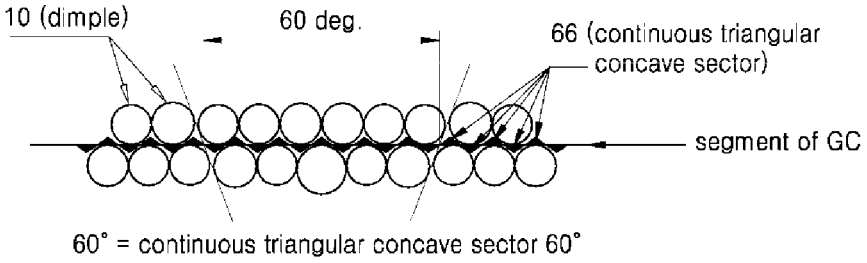
FIG. 7 illustrates a positional relationship between dimples and one of the triangular concave sectors dividing a surface of the golf ball illustrated in FIG. 6.
Figure 8:
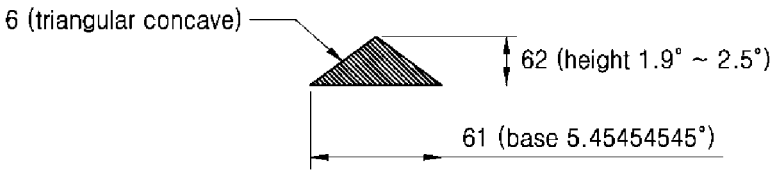
FIG. 8 illustrates a size of one triangular concave illustrated in FIG. 7.

FIG. 6 illustrates a modified example of the exemplary embodiment of FIG. 1. FIG. 7 illustrates a positional relationship between dimples and one of the triangular concave sectors dividing a surface of the golf ball illustrated in FIG. 6. FIG. 8 illustrates a size of one triangular concave illustrated in FIG. 7.

As illustrated in FIG. 6, for the spherical polyhedron of 6-8 faces identically having an angular distance of 60°, dimples may be arranged by changing the number of triangular concave included in a triangular concave sector, thereby manufacturing a golf ball. In other words, when the number of triangular concave arranged in the triangular concave sector is eleven, five dimples are arranged along a side of a spherical triangle and six dimples are arranged along a side of a spherical rectangle. In this case, as illustrated in FIG. 8, the size of the triangular concave 6 corresponds to a base 61 of about 5.45454545° and a height 62 of about 1.9° to 2.5°. The length of the base 61, as illustrated in FIG. 7, is a value obtained by dividing 60° by 11 considering that eleven triangular concave are used with respect to one triangular concave sector having an angular distance of 60°. In consideration of the angular distance, five dimples are arranged along a side of a spherical triangle of the spherical polyhedron of 6-8 faces and six dimples are arranged along a size of a spherical rectangle.

In this case, since the mold parting line is arranged in a straight line with respect to the triangular concave sector during manufacture, difficulty in the post-processing may be removed, and the dimple arrangements may form an accurate symmetry with respect to the mold parting line over an entire surface of a golf ball.

Figure 9:
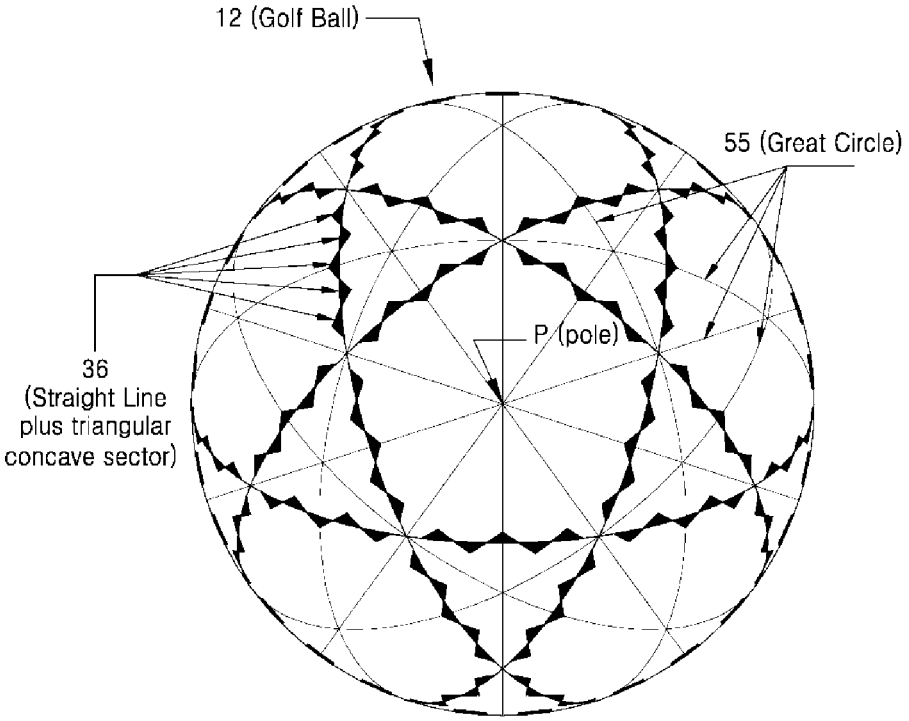
FIG. 9 illustrates a structure of a golf ball according to another exemplary embodiment.
Figure 10:
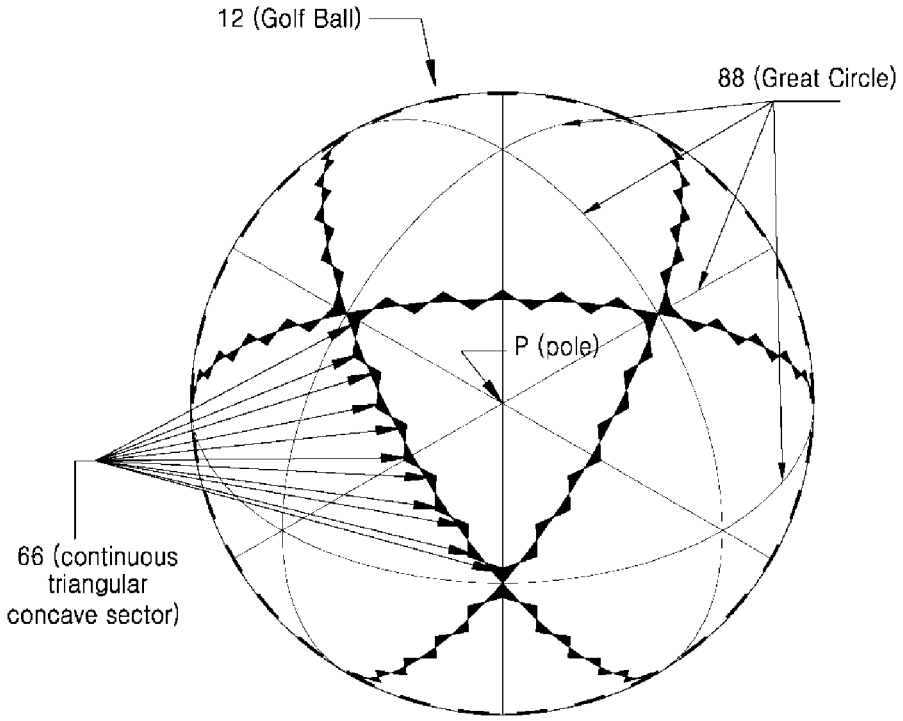
FIG. 10 illustrates a spherical surface divided by triangular concave sectors to make a dimple arrangement illustrated in FIG. 9.
Figure 11:
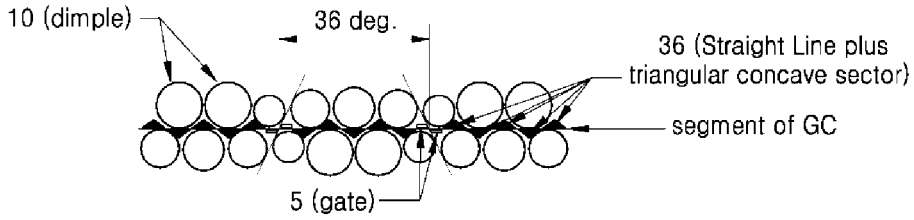
FIG. 11 illustrates a positional relationship between dimples and one of the triangular concave sectors dividing a surface of the golf ball illustrated in FIG. 9.
Figure 12:
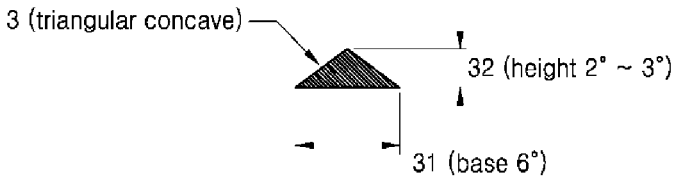
FIG. 12 illustrates a size of one triangular concave illustrated in FIG. 11.

FIG. 9 illustrates a structure of a golf ball according to another exemplary embodiment. FIG. 10 illustrates a spherical surface divided by triangular concave sectors to make a dimple arrangement illustrated in FIG. 9. FIG. 11 illustrates a positional relationship between dimples and one of the triangular concave sectors dividing a surface of the golf ball illustrated in FIG. 9. FIG. 12 illustrates a size of one triangular concave illustrated in FIG. 11.

In the golf ball according to the present exemplary embodiment illustrated in FIG. 9, dimples are arranged in each area divided into a spherical polyhedron of 20-12 faces. A combined sector 36 is arranged on each arc dividing the spherical polyhedron of 20-12 faces. In other words, a spherical surface of a golf ball is divided by the combined sector 36. The combined sector 36 is a term used to show a difference from the triangular concave sector that includes only the triangular concave according to the above-described exemplary embodiment. Since a straight section provided at each opposite end of the combined sector is the only difference from aforementioned the triangular concave sector, the combined sector may be regarded as a sort of triangular concave sector. Thus, in the present specification, the term "triangular concave sector" is defined to include the combined sector.

As illustrated in FIG. 11, the combined sector includes a straight line section and triangular concaves that are continuously arranged. In other words, the combined sector 36 including a straight line section having a predetermined angular distance of about 3° and arranged at opposite ends of the triangular concave 3 and the triangular concave-3 having a predetermined length divides a surface area of the spherical polyhedron of 20-12 faces and then dimples are arranged for each divided area, thereby manufacturing the golf ball. The straight line section is a section in which no other element such as a triangular concave or a rectangular concave is arranged, and is used as a position where the gate needed for molding is formed in a manufacture process.

As illustrated in FIG. 12, the size of the triangular concave 3 used in the present exemplary embodiment is a base 31 having an angular distance of about 6° and a height 32 having an angular distance of about 2° to about 3°. The angular distance of the base that is about 6° is a value obtained by dividing 30° by 5 when five triangular concave having an angular distance of 30°, which is obtained by subtracting the straight line section from one combined sector having an angular distance of about 36°, are continuously arranged, as illustrated in FIG. 11. In this case, this size may correspond to a size in which three dimples are arranged along one side of a spherical triangle of the spherical polyhedron of 20-12 faces and four dimples are arranged along one side of a spherical pentagon of the spherical polyhedron of 20-12 faces.

In this case, a mold parting line appears to be a straight line in the manufacture process, the dimple arrangements may form an accurate symmetry with respect to the mold parting line over an entire surface of the golf ball, and the post-processing after molding may be easily performed.

The triangular concave according to the present exemplary embodiment may have a uniform depth that is similar to or slightly shallower than the depth of a general dimple.

The golf ball in which a surface of a sphere is divided into the triangular concave sectors as in the present exemplary embodiment and dimples are arranged therein may have stability and a larger amount of lift so that superior flight performance may be obtained and a uniform result may be obtained when putting.

When a sphere is divided by general linear great circles, a mold parting line is necessarily formed on a straight line around the equator line. Accordingly, since no dimple is formed around the mold parting line, an overall dimple area ratio is lowered. However, according to the present inventive concept, although the mold parting line is a straight line, the triangular concave sector in a zigzag form contacting the mold parting line is arranged considering an area between dimples so that a dimple area ratio may be greatly increased. In other words, the golf ball, in which a surface of a sphere is divided by the triangular concave sectors each having a predetermined size and dimples are uniformly and symmetrically arranged, may have an increased dimple area ratio and may easily achieve lift, thereby having an increased flight distance.

Also, since the dimples and the triangular concaves are uniformly and symmetrically arranged and the mold parting line is straight line, the post-processing after molding may be easily performed. In other words, the dimple arrangements may form an accurate symmetry with respect to the mold parting line over an entire surface of the golf ball, and post-processing after molding may be performed in the same manner as in the golf ball divided by the linear great circles.

Furthermore, each triangular concave of the triangular concave sector has a uniform size over an entire golf ball. Accordingly, when short distance putting is performed by using the golf ball of the present invention, uniform putting may be achieved without being affected by relatively large dimples, compared to a golf ball having simply large dimples.

Figure 13:
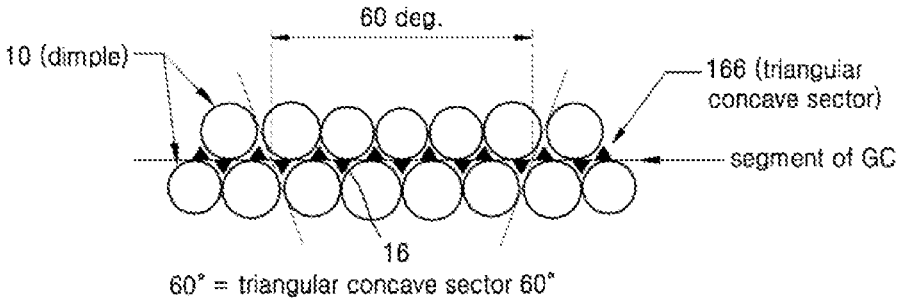
FIG. 13 illustrates a triangular concave sector according to another embodiment of the present invention.
Figure 14:
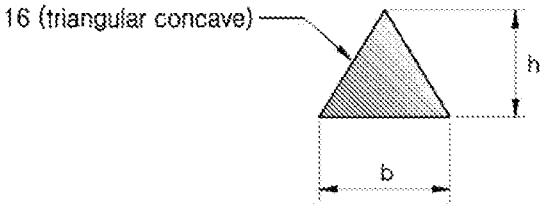
FIG. 14 illustrates a plane view of a triangular concave used in the FIG. 13.

FIG. 13 shows a triangular concave sector according to another embodiment of the present invention and FIG. 14 shows a plane view of a triangular concave used in the FIG. 13.

In FIG. 13, the triangular concave sector 166 have plurality of triangular concaves 16 and each the triangular concave is arranged without contact with the other triangular concaves. In this embodiment, the triangular concaves may fill more of the land portion between the circular dimples 10. Accordingly, compared to the embodiment of FIG. 3, the outer shape of a triangular concave 16 as shown in FIG. 14 has an increased height, h, and a decreased length of the base line, b. Preferably, the triangular concave has a height that is same or larger than haft of the base line and same or smaller than one and a haft of the base line, namely $0.25b \leq h \leq 1.0b$.

In this embodiment, maintaining the advantages of the present invention, a dimple area ratio is increased so that the lift of the golf ball be increased during the flight of the golf ball. The dimple area ratio is a ratio of a sum of the circular dimple area and the area of the triangular concave to the surface area of the golf ball.

Figure 15:
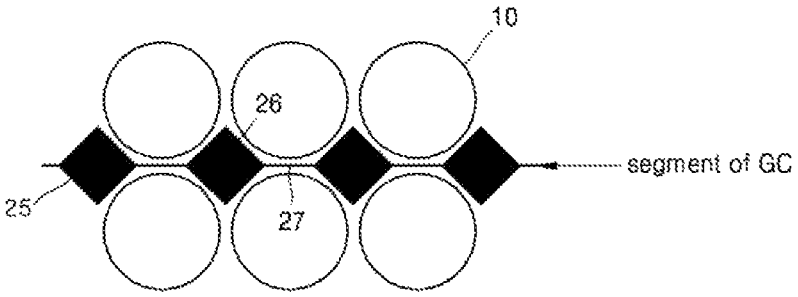
FIG. 15 illustrates the configuration of another embodiment of the present invention.

FIG. 15 illustrates the configuration of another embodiment of the present invention.

In this embodiment, the triangular concaves are located underneath the GC and on the GC. The triangular concaves underneath the GC 25 are arranged along the line segment of GC at a predetermined interval. Also, the triangular concaves on the GC 26 are arranged along the line segment of GC at a predetermined interval. All the base lines of the triangular concaves fall on the line segment of GC. A base line of the triangular concave underneath the GC 25 touches at least a part of a base line of the triangular concave on the GC 26. A height of the triangular concave in this embodiment can be made to be higher than the height of the triangular concave in the embodiment of FIG. 3. In this embodiment, it is possible that the triangular concaves occupy more area of the land portion between the circular dimples. Therefore it is possible to increase the lift according to the increase of the area ratio of a sum of the dimples and the triangular concaves to a land area of the surface of the golf ball.

In case that the circular dimples 10 are disposed in line symmetry about the line segment of GC, as shown in FIG. 15, the triangular concaves underneath the GC 25 and the triangular concaves on the GC 26 may be disposed in line symmetry about the line segment of GC.

It should be understood that exemplary embodiments described herein should be considered in a descriptive sense only and not for purposes of limitation. Descriptions of features or aspects within each exemplary embodiment should typically be considered as available for other similar features or aspects in other exemplary embodiments.

While one or more exemplary embodiments have been described with reference to the figures, it will be understood by those of ordinary skill in the art that various changes in form and details may be made therein without departing from the spirit and scope as defined by the following claims.

What is claimed is:

1. A golf ball having a sphere with a spherical surface including triangular concave sectors, in which the spherical surface is divided into a plurality of areas forming a spherical polyhedron, and a plurality of dimples are formed on each of the plurality of areas, wherein at least one of the triangular concave sectors is formed by forming a plurality of triangular concaves along great circles dividing the surface of the sphere into the plurality of areas, a planar shape of each of the plurality of triangular concaves is a triangle and bases of the triangular concaves are arranged on arcs of the great circles, and peaks of adjacent triangular concaves are located at opposite sides with respect to the arcs of the great circles.

2. The golf ball of claim 1, wherein the triangular concaves are arranged at a predetermined interval.

3. The golf ball of claim 1, wherein each triangular concave has a height, h, and a base line, b, that satisfied the equation $0.25b \leq h \leq 1.0b$.

4. The golf ball of claim 1, wherein the dimples are circular dimples that are disposed symmetrically about a line segment of one of the great circles.

5. The golf ball of claim 1, wherein the dimples are circular dimples.

6. The golf ball of claim 1, wherein a mold parting line corresponding to one of great circles on the surface of the golf ball is linear.

* * * * *